US008157325B2

(12) United States Patent
Machael et al.

(10) Patent No.: US 8,157,325 B2
(45) Date of Patent: Apr. 17, 2012

(54) CHAIR BACK REST WITH IMPROVED RESILIENCE AND SUPPORT

(75) Inventors: Jay R. Machael, Muscatine, IA (US); Marcus C. Koepke, Indianapolis, IN (US); Brian R. Trego, Muscatine, IA (US); Brian Erickson, Milan, IL (US); Amin K. Habboub, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 10/750,576

(22) Filed: Dec. 30, 2003

(65) Prior Publication Data

US 2005/0146195 A1 Jul. 7, 2005

(51) Int. Cl.

| | |
|---|---|
| *A47C 4/54* | (2006.01) |
| *A47C 7/14* | (2006.01) |
| *A47C 7/46* | (2006.01) |
| *A47C 3/025* | (2006.01) |

(52) U.S. Cl. ..... 297/284.6; 297/284.4; 297/452.41; 297/DIG. 3

(58) Field of Classification Search ..... 297/452.41, 297/284.4, 284.6, DIG. 3
See application file for complete search history.

(56) References Cited

U.S. PATENT DOCUMENTS

| | | | | |
|---|---|---|---|---|
| 2,028,060 | A | | 1/1936 | Gilbert |
| 2,627,077 | A | | 2/1953 | Forsyth |
| 3,112,956 | A | * | 12/1963 | Schick et al. ..... 297/452.41 X |
| 3,297,023 | A | | 1/1967 | Foley |
| 3,736,027 | A | | 5/1973 | Stafford |
| 3,762,769 | A | * | 10/1973 | Poschl ..... 297/284.4 |
| 4,738,486 | A | * | 4/1988 | Surber ..... 297/452.41 |
| 4,756,574 | A | | 7/1988 | Andres et al. |
| 4,759,543 | A | | 7/1988 | Feldman |
| 4,778,216 | A | | 10/1988 | Stupakis |
| 4,826,249 | A | | 5/1989 | Bradbury |
| 4,838,613 | A | * | 6/1989 | Smith ..... 297/452.41 |
| 4,944,554 | A | | 7/1990 | Gross et al. |
| 4,965,899 | A | * | 10/1990 | Sekido et al. ..... 297/284.6 |
| 5,044,030 | A | | 9/1991 | Balaton |
| 5,369,829 | A | * | 12/1994 | Jay ..... 297/452.41 X |
| 5,378,045 | A | * | 1/1995 | Siekman et al. ..... 297/452.41 X |
| 5,395,162 | A | * | 3/1995 | Jay et al. ..... 297/452.41 X |
| 5,457,833 | A | * | 10/1995 | Jay ..... 297/452.41 X |
| 5,487,197 | A | | 1/1996 | Iskra, Jr. et al. |

(Continued)

FOREIGN PATENT DOCUMENTS

DE 4004311 8/1994

(Continued)

OTHER PUBLICATIONS

U.S. Patent Publication No. US2002/0195853 A1, Heidmann, Published Dec. 26, 2002.

(Continued)

*Primary Examiner* — Rodney B White
(74) *Attorney, Agent, or Firm* — Faegre Baker Daniels LLP

(57) ABSTRACT

A chair having a seat and a back rest comprises a fluid-containing cushion in the back rest that provides passive automatically adjustable support for the user's lumbar region. The cushion can comprise one or more fluid-containing chambers encompassing the areas of the user's upper back and lumbar regions. As the user leans backs, fluid is forced from the regions adjacent the upper back down to the lumbar region to provide enhanced lumbar support to the user.

31 Claims, 2 Drawing Sheets

U.S. PATENT DOCUMENTS

| | | | | |
|---|---|---|---|---|
| 5,490,299 | A * | 2/1996 | Dinsmoor et al. | 297/452.41 X |
| 5,513,899 | A * | 5/1996 | Michaels et al. | 297/452.41 |
| 5,556,169 | A * | 9/1996 | Parrish et al. | 297/452.41 X |
| 5,558,398 | A | 9/1996 | Santos | |
| 5,634,685 | A * | 6/1997 | Herring | 297/452.41 X |
| 5,645,319 | A | 7/1997 | Parks, Jr. | |
| 5,671,977 | A * | 9/1997 | Jay et al. | 297/452.41 X |
| 5,839,140 | A | 11/1998 | Wilkerson | |
| 5,839,788 | A * | 11/1998 | Orr, III | 297/452.41 |
| 5,860,705 | A * | 1/1999 | Ridder | 297/452.41 |
| 5,951,111 | A | 9/1999 | Klimenko | |
| 6,126,152 | A | 10/2000 | Santos et al. | |
| 6,135,551 | A * | 10/2000 | Linder | 297/452.41 X |
| 6,189,972 | B1 * | 2/2001 | Chu et al. | 297/284.4 |
| 6,209,962 | B1 * | 4/2001 | Sobel et al. | 297/452.41 X |
| 6,241,320 | B1 * | 6/2001 | Chew et al. | 297/452.41 X |
| 6,260,921 | B1 * | 7/2001 | Chu et al. | 297/284.4 |
| 6,349,992 | B1 * | 2/2002 | Knoblock et al. | 297/284.4 X |
| 6,367,877 | B1 * | 4/2002 | Knoblock et al. | 297/284.4 X |
| 6,382,719 | B1 * | 5/2002 | Heidmann et al. | 297/284.4 X |
| 6,394,545 | B2 * | 5/2002 | Knoblock et al. | 297/284.4 |
| 6,394,546 | B1 * | 5/2002 | Knoblock et al. | 297/284.4 X |
| 6,460,928 | B2 * | 10/2002 | Knoblock et al. | 297/284.4 X |
| 6,478,379 | B1 * | 11/2002 | Ambasz | 297/284.3 X |
| 6,494,534 | B1 * | 12/2002 | Li | 297/452.41 X |
| 6,523,898 | B1 * | 2/2003 | Ball et al. | 297/284.4 X |
| 6,546,579 | B1 | 4/2003 | Leventhal et al. | |
| 6,616,228 | B2 * | 9/2003 | Heidmann | 297/284.4 |
| 6,623,080 | B2 * | 9/2003 | Clapper | 297/452.41 |
| 6,677,026 | B1 * | 1/2004 | Yates | 297/452.41 X |
| 6,913,315 | B2 * | 7/2005 | Ball et al. | 297/284.4 X |
| 6,991,291 | B2 * | 1/2006 | Knoblock et al. | 297/284.4 |
| 7,032,971 | B2 * | 4/2006 | Williams | 297/284.4 |
| 7,216,936 | B2 * | 5/2007 | Peterson | 297/284.4 X |
| 2003/0030319 | A1 * | 2/2003 | Clapper | 297/452.41 |
| 2003/0107252 | A1 * | 6/2003 | Kinoshita et al. | 297/301.1 |
| 2003/0127896 | A1 * | 7/2003 | Deimen et al. | 297/301.1 |
| 2003/0151287 | A1 * | 8/2003 | Ueda et al. | 297/301.1 |
| 2003/0197413 | A1 * | 10/2003 | Walker et al. | 297/452.19 |
| 2004/0084943 | A1 * | 5/2004 | Fisher | 297/335 |
| 2004/0124679 | A1 * | 7/2004 | Teppo et al. | 297/284.4 |
| 2004/0160112 | A1 * | 8/2004 | Clapper | 297/452.41 |
| 2004/0222684 | A1 * | 11/2004 | Van Sickle | 297/452.41 |
| 2004/0232756 | A1 * | 11/2004 | Lin | 297/452.41 |
| 2004/0239171 | A1 | 12/2004 | Inchaustegui | 297/452.41 |
| 2005/0052061 | A1 * | 3/2005 | Deimen et al. | 297/301.1 |
| 2005/0093354 | A1 * | 5/2005 | Ball et al. | 297/284.4 |
| 2005/0127729 | A1 * | 6/2005 | Knoblock et al. | 297/284.4 |
| 2007/0024098 | A1 * | 2/2007 | Knoblock et al. | 297/284.4 |
| 2007/0057549 | A1 * | 3/2007 | Ball et al. | 297/284.4 |

FOREIGN PATENT DOCUMENTS

| | | |
|---|---|---|
| EP | 0068211 | 1/1983 |
| EP | 0619968 | 4/1994 |
| EP | 1319353 | 6/2003 |
| FR | 25574441 | 12/1983 |
| FR | 2557441 A1 * | 7/1985 |
| GB | 1032354 | 6/1966 |

OTHER PUBLICATIONS

U.S. Patent Publication No. US2002/0195863 A1, Su., Published Dec. 26, 2002.

U.S. Patent Publication No. US2004/0021361 A1, Park et al., Published Feb. 5, 2004.

U.S. Patent Publication No. US2002/0074841 A1, Chen, Published Jun. 20, 2002.

Supplementary European Search Report for European patent application No. 04815616.0, dated Feb. 6, 2008, 4 pp.

European Patent Office, Examination Report for European Patent Application 04815616.0, mailed May 20, 2009.

* cited by examiner

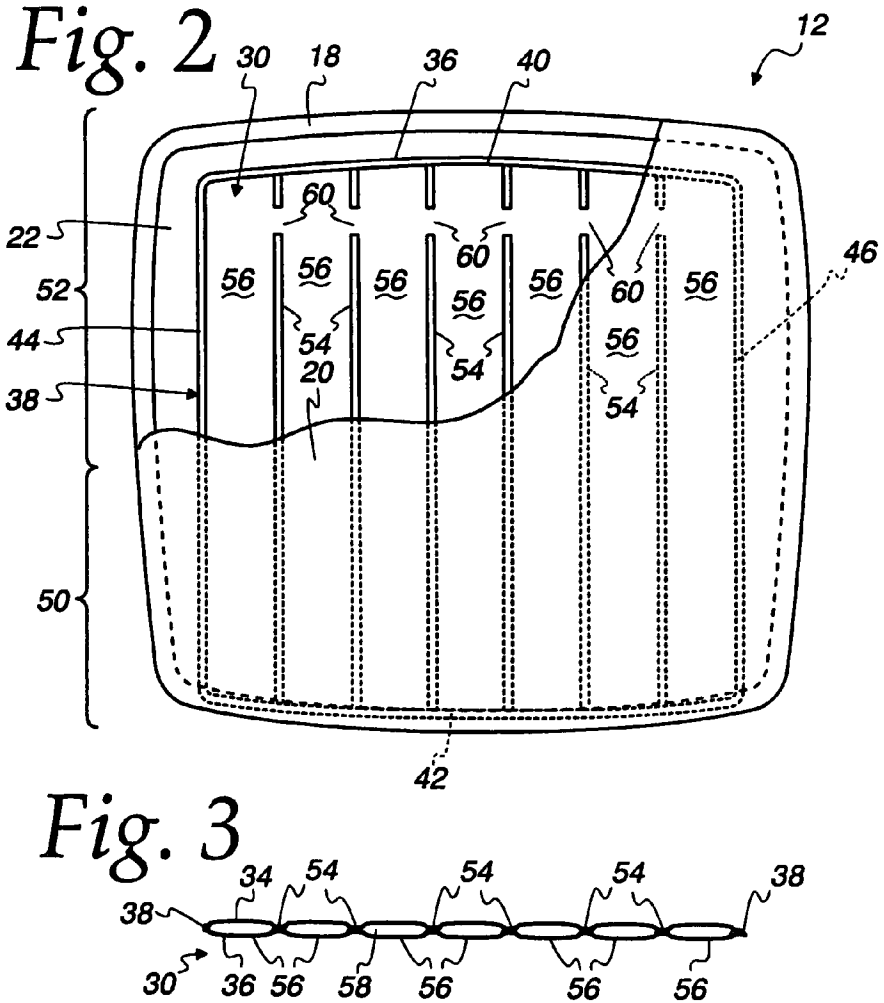
Fig. 2
Fig. 3
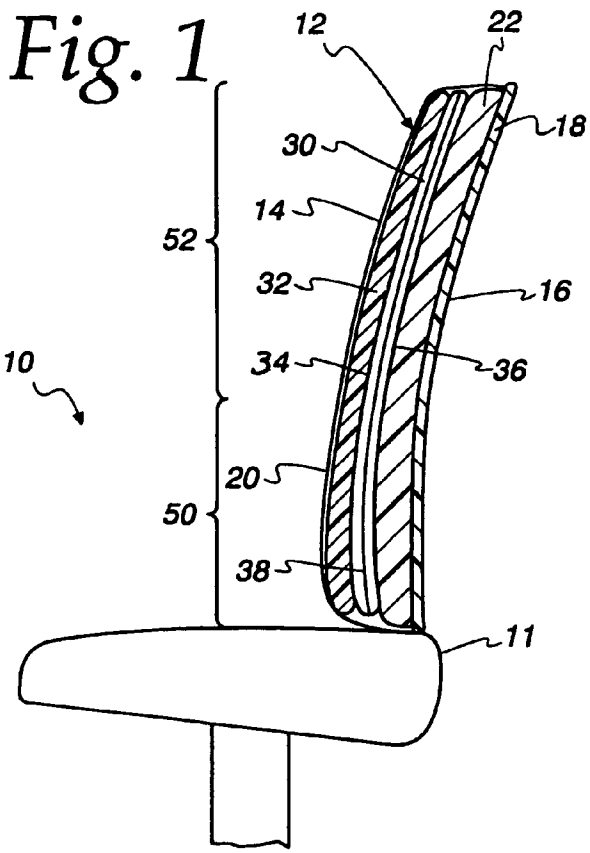
Fig. 1

CHAIR BACK REST WITH IMPROVED RESILIENCE AND SUPPORT

This patent application is related to the patent applications "Chair with Backward and Forward Passive Tilt Capabilities," application Ser. No. 10/749,008; "Horizontally Adjustable Chair Arm Rest," application Ser. No. 10/748,537; "Vertically Adjustable Chair Arm Rest," application Ser. No. 10/749,010; "Chair with Adjustable Seat Depth," application Ser. No. 10/748,079; and "Chair with Tilt Lock Mechanism," application Ser. No. 10/749,009; each application being filed on even date herewith and incorporated herein by reference in its entirety.

BACKGROUND OF THE INVENTION

This invention relates to a chair having a seat and a back, wherein the back includes a cushion for providing improved resilience and support. In particular, the invention relates to a chair for office use wherein the back includes a cushion for providing improved resilience and support, which cushion automatically self-adjusts as the back reclines.

It is known in the art of office seating design to provide an office chair with a back that adjustably reclines in response to pressure exerted by the user's back, and then returns to its original position as the user's back moves forward. Such chairs are typically designed to provide a support for the user's lumbar region when the back is in the fully upright position. The lumber support can be either fixed or manually adjustable. One difficulty with such prior art chairs is that a fixed lumbar support, or even one that is manually adjustable, may not meet and comfortably support the lumbar regions of users of different heights. Another difficulty with such prior art chairs is that as the user reclines, the position of the user's lumbar region shifts with respect to the position of the fixed lumbar support in the backrest portion. Thus as the backrest portion reclines, the user's lumbar region may not receive optimum support over the range of motion of the backrest.

It is thus one object of the invention to provide a chair back that includes a cushion for automatically providing resilience and support for a user's back.

It is another object of the invention to provide a chair back that includes a cushion for providing lumbar support that automatically self-adjusts to comfortably support users of different heights.

It is still another object of the invention to provide a chair back that includes a cushion for providing adjustable resilience and support that automatically self-adjusts to comfortably support users as the user changes positions against the back, and as the back reclines over different angles of inclination in response to pressure exerted by the user's back.

SUMMARY OF THE INVENTION

These and other objects of the invention are met by a chair having a seat and a back, the back being capable of reclining in response to pressure exerted thereon by a user's back, the chair back including in its interior a cushion for providing automatically self-adjusting resilience and support, the cushion being fluid-containing. The cushion is substantially coextensive with at least that region of the surface of the chair back that engages the user's lumbar region. The cushion provides automatically varying pressure in response to the variable pressure exerted by different regions of the user's lumbar region, or other regions of the user's back that overlay the cushion. The cushion automatically accommodates users of different heights, and automatically self-adjusts to variations in applied pressures as the back reclines through a range of angles.

In a preferred embodiment, the cushion comprises two sheets of flexible, air-impermeable plastic film, sealed together so as to define a volume having a lower region and an upper region. The cushion preferably has seams that define a plurality of channels extending generally from the lower region to the upper region when the cushion is installed in a chair back. As the user leans his or her back against the chair back, greater pressure will be exerted against the cushion by the user's upper back and shoulders than by the user's lumbar region. This will force fluid from the upper region of the cushion downward toward the lower region, to provide increased resilient lumbar support for the user. The precise location of the increased lumbar support can vary along the length of the channels, so as to provide improved lumbar support as an individual user shifts position in the chair, and for users of different heights. Moreover, as the individual user reclines the backrest, the location of the increased lumbar support can shift in response to variable pressures exerted by different regions of the user's back, so that the improved chair back automatically provides optimum resilient back support to the user at any angle of inclination.

DESCRIPTION OF THE FIGURES

The present invention is more readily understood by reference to the figures, wherein FIG. 1 is a diagrammatic, sectional elevation view of a chair having a back of the invention;

FIG. 2 is a front elevation view, partially cutaway, of an embodiment of a chair back;

FIG. 3 is a sectional plan view of the cushion of FIG. 2; and

DETAILED DESCRIPTION OF THE INVENTION

Figure 4:
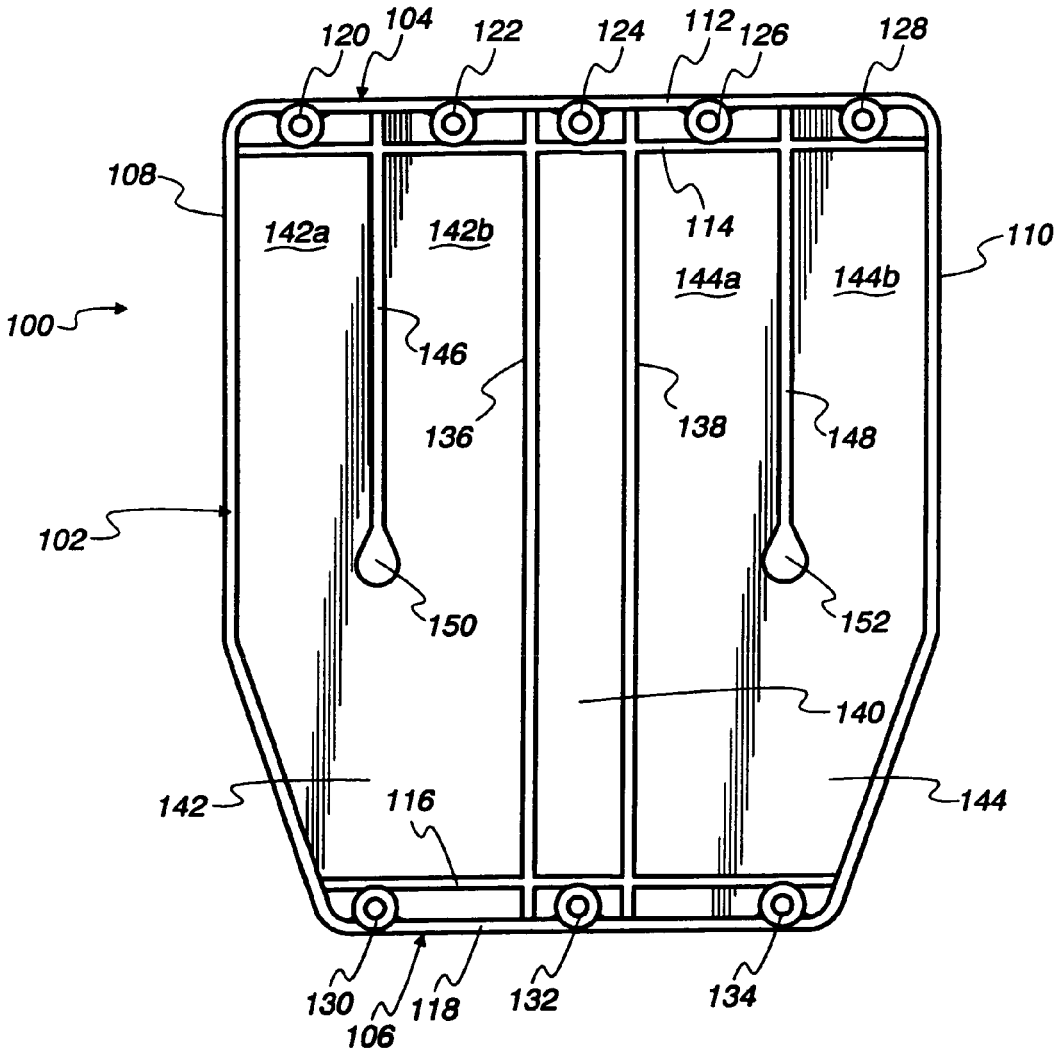
FIG. 4 is a front elevation view of a another embodiment of a cushion.

As illustrated in FIG. 1, a chair 10 includes a seat 11 and a back 12 having a forward facing side 14 and a rearward facing side 16. The back 12 comprises a substantially rigid support member 18, covered at least on its forward facing side with an upholstery-type covering 20 such as fabric, vinyl or leather. Optionally a pad 22 of foam or other resilient material such as is known in the art, is disposed on the forward facing surface of the support member 18.

A fluid-containing cushion 30, FIGS. 1-3, is located between the support member 18 and the upholstery cover 20. An optional pad 32 of foam or other resilient material can be disposed between the cushion 30 and the upholstery cover 20. The cushion 30 comprises a first layer 34 and a second layer 36, each of the layers being made of an air-impermeable plastic, the layers being hermetically sealed together about their respective peripheries to form a peripheral seal 38. The cushion includes a top portion 40, a bottom portion 42, a left side portion 44 and a right side portion 46. The cushion 30 preferably is sized and dimensioned to be substantially coextensive with at least that region of the chair back 12 that will experience pressure exerted by the back of a user of the chair 10, extending from the upper back and shoulders down to and including the lumbar region. For ease of reference, the structure of the invention will be discussed in terms of a lower region 50 and an upper region 52, although it will be appreciated that the actual proportions of the inventive cushion that will serve as lumbar support region and upper back support region, respectively, will depend upon the size and height of the individual user.

In a preferred embodiment, the two layers 34, 36 of the cushion 30 are further joined by a plurality of seams 54. The seams 54 together with the peripheral seal 38 define a plurality of channels 56 that generally extend from the lower region 50 to the upper region 52. The channels can be substantially vertical, as illustrated in the figures, or they can be oriented at different angles.

Each channel 56 contains a fluid 58. The channels are in fluid communication with one another through a plurality of openings 60 in each of the seams 54. The sizes and locations of the openings 60 can be varied to achieve a desired response. Alternatively, openings 60 can be omitted, and each channel 56 will be completely sealed unto itself.

The fluid in the cushion can be air, gas or gas mixtures, liquid, or a flowable gel. The cushion should be only partially filled with fluid, so that the fluid can move from one region of the cushion to another, or from one region in a channel to another, in response to variations in applied pressure caused by movements of the user.

In use, when a user of the chair leans against the chair back 12, the user's back will be in contact with forward surface 14 and exert pressure thereon. The user's upper back and shoulders will cause some compression of partially filled channels primarily in upper region 52, causing fluid to be driven into lower lumbar region 50 where it will provide additional support to the user's lumbar region, where such support often is most needed. It may be seen that the exact location of the additional lumbar support along the length of channels will be determined automatically by the physical dimensions of each individual user. It is not necessary for an individual user to make manual adjustments to the chair in order to obtain optimum support in the lumbar region. Thus, the fluid support system of the instant invention provides an automatic passive adjustable support of the lumbar region, responsive to each individual user. The inventive system advantageously applies equalized pressure along the user's back.

Moreover, when a user reclines the chair back, the individual's spinal curvature will change, with the manner and amount of change depending on the individual's physical dimensions and the angle of inclination of the chair back. The lumbar region of the support member 18 is curved to conform generally to the lumbar region of a user. Generally, the radius of curvature of a user's back will be smaller than the radius of curvature of a lumbar region of the support member 18. The space between the user's lumbar region and the lumbar region of the support member 18 defines a relatively small volume to be filled with fluid. As the chair back reclines, the user's spinal curvature changes, and in particular the arch of the user's lumbar region and upper back. The areas of pressure exerted by the user's back when reclined will vary along the length of the channels. Fluid within the channels will shift away from the areas where pressure is greatest, such as upper region 52 contacted by the user's upper back and shoulders, and towards the region where pressure is least, such as lower region 50 at the user's lumbar area. Typically, it is the lumbar region where support is needed most. The shifting of fluid within the channels will happen automatically as the user alternately reclines and straightens the chair back. At the same time, there will be less fluid volume in the cushion in upper region 52, such that there will be greater stability of the user's upper back, with no unwanted side-to-side rolling motion. Thus the fluid-containing cushion of the instant invention automatically adjusts to the needs of different individual users, and to the different needs of a single individual as that user assumes different angles of inclination and different positions during the course of ordinary use of the chair. Advantageously, the user will not feel any discontinuity in pressure or support in the lumbar region, regardless of the angle of inclination; i.e., there is no "edge" where lumbar support ends, as can be experienced with systems that employ a discrete mechanical lumbar support member.

It will be appreciated that the channels preferably are not filled to their highest capacity. If the pressure in the channels were too high, then the cushion 30 would not yield in response to unevenly applied pressures; i.e., the fluid would not be able to shift from a region of higher applied pressure such as the upper region 52 to a region of lower applied pressure such as the lower or lumbar region 50.

The cushion of the instant invention can be manufactured of fluid-impermeable plastic films that can be sealed together to form hermetic seals. Such plastic films can include, for example, vinyls, polyurethanes, polyvinyl chlorides, ethylene vinyl acetates, urethane coated membranes, polyolefins, sarans, and engineered multi-layer films. The plastic film selected for the cushion will be practically air-impermeable, having an air transmissibility rate as measured by ASTM D1434 (Standard Test Method for Determining Gas Permeability Characteristics of Plastic Film and Sheeting) of less than about 100 $cm^3/m^2/day/atm$; preferably less than about 10 $cm^3/m^2/day/atm$; and most preferably less than about 5 $cm^3/m^2/day/atm$. The thickness of the plastic film can be in the range of about 2-20 mil, more preferably about 4-10 mil, and optimally about 4 mil. One particularly preferred material for an air-containing cushion is 4.0 mil Saranex 15, a multilayer film available from Dow Medical Films and comprising a "Saran®" barrier resin co-extruded between outer layers of polyolefins. The films can be sealed together to form the peripheral seal 38 and seams 54 by known sealing means, such as adhesives, heat sealing, ultrasonic sealing, and RF sealing. Those skilled in the art will be able to select a sealing means suitable for the particular film material being used. A desired amount of air is injected into the various chambers of the cushion during the sealing process by methods known in the art of the manufacture of air-filled bladders.

The dimensions of the cushion, and the size, number, and angular orientation of the channels of the cushion, can be varied to accommodate (1) the needs of different users; (2) the design of the chair as a whole, including whether any optional pads of foam or other resilient material are used in front of and/or behind the cushion, and the characteristics of the optional pads; and (3) the different applications for which the chair will be used. The size and number of the openings 60 also can be varied to achieve a desired fluidic response. Further, additional padding such as a foam layer or a gel layer can be interposed between the cushion 30 and the upholstery cover or layer 20.

FIG. 4 illustrates a preferred embodiment of a chair back cushion 100. The cushion 100 comprises two sheets of plastic film (like that shown in FIG. 3) sealed together with a peripheral seal 102 along a top portion 104, bottom portion 106, left side portion 108 and right side portion 110. The top portion 104 of the cushion 100 includes two parallel, horizontal seals 112, 114, and the bottom portion 106 of the cushion also includes two parallel, horizontal seals 116, 118. Between the two upper seals 112, 114 are circular seals 120, 122, 124, 126, 128. Between the two bottom seals 116, 118 are three circular seals 130, 132, 134. Extending the full vertical length of the cushion are two seams that divide the interior of cushion 100 into a central or center chamber 140 and left and right side chambers 142, 144. The central and side chambers are filled with air. Partial or short middle seams 146, 148 in each of the side chambers 142, 144 extend vertically from about the upper seals 112, 114 down to about the vertical midpoint of the chambers. These partial middle seams 146, 148 prevent the side chambers 142, 144 from bulging too much at the upper end, and maintain a more uniform pressure level throughout the length of the cushion. The middle seams 146, 148 divide each respective left side and right side chambers into two chambers 142*a*, 142*b* and 144*a* and 144*b*. It will be understood that middle seams 146, 148 could be in the forms of spot welds, i.e., discrete spots where the two layers of cushion 100 are bonded together. Such spots could be arranged in lines or over an area, as long as they serve to moderate expansion of the side chambers 142, 141. In the illustrated embodiment, the middle seams 146, 148 terminates in enlarged tear-drop shaped configurations 150, 152, which relieves localized stresses in the plastic sheets.

The cushion 100 is about 18 inches high and about 14 inches wide along its top portion 104. The sides taper inward slightly beginning about six inches from the bottom portion 106, such that the width of the bottom portion 106 is about 10 inches. The center chamber 140 is pressurized with about 100 cubic centimeters of air, and the side chambers 142, 144 are each pressurized with about 300 cubic centimeters of air. Alternatively, an external pump can be provided so that the user can adjust the amount of air in the cushion in accordance with individual preferences. The center chamber 140 is of a generally constant width in a vertical direction and each of the chambers 140, 142, 144 is sealed from one another by the vertical seams 136, 138.

The present invention provides a significant improvement over prior art chair back supports. Unlike foam pads, which simply compress in response to applied pressure, the fluidic support of the present invention redistributes pressure, such that as one part of the cushion compresses, another part expands, to provide additional support where it is needed most.

While the novel features of the present invention have been described with respect to particular embodiments, it will be appreciated by those skilled in the art that substitution of materials and modifications as to structure and details can be made without departing from the spirit of the invention.

What is claimed:

1. A chair having a seat and a tiltable back, said back comprising:

a rear support including a lumbar region defined by a curvature in the rear support, wherein the curvature conforms generally to a user's lumbar region; and a fluid containing cushion having a seal along a top portion, a seal along a bottom portion, a seal along a left side portion and a seal along a right side portion, said fluid containing cushion located forward of said rear support; wherein said fluid containing cushion includes two layers directly sealed together by a seam to form a vertically extending central chamber of generally constant width and vertically extending left and right side chambers, each of said chambers being completely sealed from one another.

2. The chair of claim 1 wherein said fluid containing cushion is hermetically sealed.

3. The chair of claim 1 wherein said fluid containing cushion is sized and dimensioned to be at least coextensive with the area of the user's lumbar region.

4. The chair of claim 1 wherein said fluid containing cushion has a lower region and an upper region, and said cushion comprises one or more channels extending between said lower region and said upper region.

5. The chair of claim 4 wherein said channels are substantially vertical.

6. The chair of claim 1 wherein said fluid containing cushion is made of one or more plastic films selected from the group consisting of vinyls, polyurethanes, polyvinyl chlorides, ethylene vinyl acetates, urethane coated membranes, polyolfins, sarans, and engineered multi-layer films.

7. The chair of claim 1 wherein said seals are formed by a method selected from the group consisting of heat sealing, ultrasonic sealing, RF sealing, and adhesives.

8. The chair of claim 1 wherein said fluid is selected from the group consisting of air, gas or gas mixtures, liquid, and flowable gel.

9. The chair of claim 1 wherein said cushion comprises a plurality of chambers extending from a lower region of the cushion to an upper region of the cushion.

10. The chair of claim 1 wherein:

said sealed central chamber extends between said top and bottom portions of said cushion between two spaced apart straight, vertically extending seams.

11. The chair of claim 10 wherein:

said left and right chambers extend between said top and bottom portions of said cushion.

12. The chair of claim 1 wherein:

said left side chamber is partially divided by a vertically directed seam; and said right side chamber is partially divided by a vertically directed seam.

13. The chair of claim 1 wherein:

said left side chamber includes a middle seam extending from said seal along said top portion of said cushion; and said right side chamber includes a middle seam extending from said seal along said top portion of said cushion.

14. The chair of claim 13 wherein:

said middle seam of said left chamber includes an enlarged lower end portion; and said middle seam of said right chamber includes an enlarged lower end portion.

15. The chair of claim 14 wherein:

said sealed central chamber extends between said top and bottom portions of said cushion between two spaced apart vertically extending seams.

16. The chair of claim 15 wherein:

said left and right chambers extend between said top and bottom portions of said cushions.

17. The chair of claim 16 wherein:

said two layers of said fluid containing cushion are generally air impermeable.

18. The chair of claim 17 wherein:

each of said two layers of said fluid containing cushion includes multiple layers.

19. The chair of claim 1 wherein:

said two layers of said fluid containing cushion are generally air impermeable.

20. The chair of claim 19 wherein:

each of said two layers of said fluid containing cushion includes multiple layers.

21. A chair having a seat and a tiltable back, said back comprising:

a rear support including a lumbar region defined by a curvature in the rear support, wherein the curvature conforms generally to a user's lumbar region;

a fluid containing cushion having a top portion, a bottom portion, a left side portion and a right side portion, said fluid containing cushion located forward of said rear support;

a cushion layer located forward of said fluid containing cushion; and an upholstery layer located forward of said cushion layer; wherein said fluid containing cushion includes two layers sealed along a top portion, a bottom portion, a left side portion and a right side portion, first and second straight vertical seals attaching said two layers, said first and second vertical seals forming vertical seams extending from the top portion seal to the bottom portion seal to form a first completely sealed centrally located fluid chamber, a third vertical seam extending from the top portion seal toward the bottom portion seal to form second and third side chambers, said second and third side chambers being in fluid communication with each other but not with said first chamber, and a fourth vertical seam extending from the top portion seal toward the bottom portion seal to form fourth and fifth side chambers, said fourth and fifth side chambers being in fluid communication with each other but not with said first chamber.

22. The chair of claim 21 wherein:

said two layers of said fluid containing cushion are generally air impermeable.

23. The chair of claim 22 wherein:

each of said two layers of said fluid containing cushion includes multiple layers.

24. A chair having a seat and a tiltable back, said back comprising:

a rear support including a lumbar region defined by a curvature in the rear support, wherein the curvature conforms generally to a lumbar region of a user;

a fluid containing cushion having a seal along a top portion, a seal along a bottom portion, a seal along a left side portion and a seal along a right side portion, said fluid containing cushion located forward of said rear support; and fluid, wherein the fluid at least partially fills the fluid containing cushion, wherein the fluid containing cushion includes two layers directly sealed together by a seam to form a vertically extending central chamber of generally constant width and vertically extending left and right side chambers, each of said chambers being completely sealed from one another, and wherein as the user reclines the tiltable back, the fluid in the fluid containing cushion at least partially shifts away from a first region where a back or shoulder of the user contacts the fluid containing cushion toward a second region where a lumbar area of the user contacts the fluid containing cushion.

25. A chair having a seat and a tiltable back, said back comprising:

a rear support including a lumbar region defined by a curvature in the rear support, wherein the curvature conforms generally to a user's lumbar region; and a fluid containing cushion having a seal along a top portion, a seal along a bottom portion, a seal along a left side portion and a seal along a right side portion, said fluid containing cushion located forward of said rear support; wherein said fluid containing cushion includes two layers sealed to form a vertically extending central chamber of generally constant width and vertically extending left and right side chambers, each of said chambers being completely sealed from one another;

said left side chamber is partially divided by a vertically directed seam;

said right side chamber is partially divided by a vertically directed seam;

said left side chamber includes a middle seam extending from said seal along said top portion of said cushion; and said right side chamber includes a middle seam extending from said seal along said top portion of said cushion.

26. The chair of claim 25 wherein:

said middle seam of said left chamber includes an enlarged lower end portion; and said middle seam of said right chamber includes an enlarged lower end portion.

27. The chair of claim 26 wherein:

said sealed central chamber extends between said top and bottom portions of said cushion between two spaced apart vertically extending seams.

28. The chair of claim 27 wherein:

said left and right chambers extend between said top and bottom portions of said cushions.

29. The chair of claim 28 wherein:

said two layers of said fluid containing cushion are generally air impermeable.

30. The chair of claim 29 wherein:

each of said two layers of said fluid containing cushion includes multiple layers.

31. A chair having a seat and a tiltable back, said back comprising:

a rear support including a lumbar region defined by a curvature in the rear support, wherein the curvature conforms generally to a user's lumbar region; and a fluid containing cushion having a seal along a top portion, a seal along a bottom portion, a seal along a left side portion and a seal along a right side portion, said fluid containing cushion located forward of said rear support; wherein said fluid containing cushion includes two layers sealed to form a vertically extending central chamber of generally constant width and vertically extending left and right side chambers, each of said chambers being completely sealed from one another;

said left side chamber includes a partial middle seam extending from said seal along said top portion of said cushion towards the bottom portion but does not reach the seal along the bottom portion; and said right side chamber includes a partial middle seam extending from said seal along said top portion of said cushion but does not reach the seal along the bottom portion.

* * * * *